United States Patent [19]

Mall

[11] Patent Number: 4,996,931

[45] Date of Patent: Mar. 5, 1991

[54] SEWING UNIT WITH A TRANSPORT DEVICE

[75] Inventor: Günter Mall, Kaiserslautern, Fed. Rep. of Germany

[73] Assignee: Pfaff Industriemaschinen GmbH, Kaiserslautern, Fed. Rep. of Germany

[21] Appl. No.: 360,263

[22] Filed: Jun. 2, 1989

[30] Foreign Application Priority Data

Jun. 6, 1988 [DE] Fed. Rep. of Germany ..... 3819136

[51] Int. Cl.[5] ..... D05B 21/00; D05B 33/00

[52] U.S. Cl. ..... 112/121.12; 112/121.15; 112/121.29

[58] Field of Search ..... 112/121.12, 121.15, 112/102, 303, 311; 271/267; 414/744.4, 744.8, 751, 917

[56] References Cited

U.S. PATENT DOCUMENTS

| | | | |
|---|---|---|---|
| 3,399,640 | 9/1968 | Bryan et al. | 112/121.15 |
| 3,601,393 | 8/1971 | Hawley | 271/267 |
| 3,621,801 | 11/1971 | Huddleston | 112/121.29 X |
| 3,789,781 | 2/1974 | Carson et al. | 112/121.12 X |
| 4,181,085 | 1/1980 | Conner, Jr. | 112/121.12 |
| 4,635,493 | 1/1987 | Buckley | 414/917 X |
| 4,708,334 | 11/1987 | Flavell et al. | 271/84 X |

*Primary Examiner*—Werner H. Schroeder
*Assistant Examiner*—Paul C. Lewis
*Attorney, Agent, or Firm*—McGlew & Tuttle

[57] ABSTRACT

A sewing unit including a sewing machine and a transport device is provided in which the transport device is arranged so as to form a free access area at a front side of a sewing machine of the sewing unit such that a workpiece positioning may be executed without any impediment by the transport device. The transport device is connected at one end to a workpiece holder and is connected at another end to a bearing device which is set back from a front edge of the sewing unit. The transport device is moved along a path defined by a guide device and is moved by a driving device. Each of the guide device, drive device and bearing device being positioned away from a front end of the unit to define the free access area.

11 Claims, 2 Drawing Sheets

SEWING UNIT WITH A TRANSPORT DEVICE

FIELD OF THE INVENTION

The invention relates to a sewing unit with a sewing machine and a transport device connected with a drive including a guide device for guiding the transport of a workpiece along a path of movement, the guide device and transport device being disposed on a table top of the sewing unit.

BACKGROUND OF THE INVENTION

A lay-out plan publication of the company Pfaff for a pocket-attaching sewing machine of the class 3518 (date of publication: March 1986) describes a transport device which is arranged movably in a guide running along the front of said sewing unit. The transport device serves for the transport of a work piece comprising a piece of cloth and a cut pocket to be sewn on from a folder to a feeding advancing means of the sewing unit.

In order to simplify the positioning with patterned cloth, the sewing unit can be equipped with a positioning table, which can be fed from the front side of the sewing unit. The work piece is transferred by the positioning table to the folder and taken over by it.

During the taking-over of the work piece the cut pocket may be moved relative to the piece of cloth underneath and is then no longer aligned accurately relative to its pattern.

SUMMARY AND OBJECTS OF THE INVENTION

It is an object of the invention of developing a sewing unit with a transport device so that the work piece is directly positionable and exactly alignable with regard to the pattern from the front side of the sewing unit without being impeded by the transport device.

According to the invention, a sewing unit is provided including a sewing machine and transport device arrangement. The arrangement includes a transport means supported on a table top work surface. The transport means is connected to a workpiece holder having a forward edge. The transport means is for supporting the workpiece holder and moving the workpiece holder between a first and second position on the tabletop. Bearing means are provided connected to the table top and connected to the transport means for supporting the transport means during movement. Driving means are connected to the transport means for moving the transport means between the first and second position. Guide means are provided connected to the transport means for defining a path of the transport means between the first and the second position. Each of the bearing means, driving means and guide means are positioned behind the forward edge of the workpiece holder and are positioned to define a free access area at a front side of the sewing machine.

As the contact points of the bearing means, the drive unit and the guiding device are recessed with regard to the front edge of the work piece holder, the work piece holder is guided along its path of movement without any of these other devices being arranged between it and the operator standing at the front side of the sewing unit and access to the sewing unit is neither hindered nor blocked from this side. Due to this the work piece holder can be fed directly from the front of the sewing unit and the various layers of cloth having any pattern can be aligned pattern-truly (matched alignment).

The transport device includes a tie rod which engages the bearing means at one end and engages the workpiece holder at another end. The tie rod is advantageously in the shape of a swivel arm and provides for the workpiece holder being moved along an arc of a circle whose radius is equivalent to the length of the swivel arm.

The tie rod is provided with a guide rod for allowing the workpiece holder, depending on the position of the tie rod, to be moved into a position assigned to the guide rod. These features are provided to guide the work piece holder so that it is moved into a certain position which is desired or required in specific sections of its path of movement.

The guide rod is an auxiliary rod running parallel to the tie rod which together are articulated with the workpiece holder and also articulated to the bearing device. This provides a very simple arrangement of the tie rod by means of which the workpiece holder is guided parallel relative to itself over the entirety of its path of movement. This allows in particular for the advantageous transport of large work pieces which extend over the table top.

The bearing device is a movable part of a differential arrangement which is actuated in dependence upon a predetermined path of movement of the workpiece holder and the movement of the transport means.

The bearing device includes a slide mounted on the rails of the differential arrangements. These features provide a favorable bearing arrangement and also allow the specific movement of the transport means with the workpiece holder. The transport device is thereby advantageously guided with additional degrees of freedom. The degrees of freedom are used to guide the work piece holder also along such a path of movement which it could not follow without the differential mechanism. For many purposes it might make sense to align the path of movement in a straight line and parallel with regard to the front edge of the table top as this results in minimal transport distances.

The guide means includes a guide member forming a guide track in a movement area of the transport means. The guide member is provided for the reception of a guide element associated with the transport means and including a driving connection with the bearing means. This arrangement allows the bearing means to be actuated through the guide device. A change of the path of the guide track or slot in the guide member results in the respective balancing movement of the bearing means. The guide track is formed so that there is a specifically geared relationship of movement between it and the path of movement of the work piece holder, the relationship being determined by the design of the transport device.

The guide member is preferably a template member mounted on the table top to define a guide slot. The guide element includes a rotatably mounted roller running in the guide slot.

The bearing means receives the transport means movably in a vertical direction. The vertical movement may be actuated by movement controllable in dependence upon the position of the transport means. A lifting means may be carried by a slide arrangement which is guided movably in the horizontal direction in a plane for synchronized movement with the bearing means. The work piece holder of the transport device is guided on various vertical planes in various phases of its movement. The work piece holder is e.g. lowered onto the work piece for its transport, while it is lifted off it during the backward movement.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figure 1:
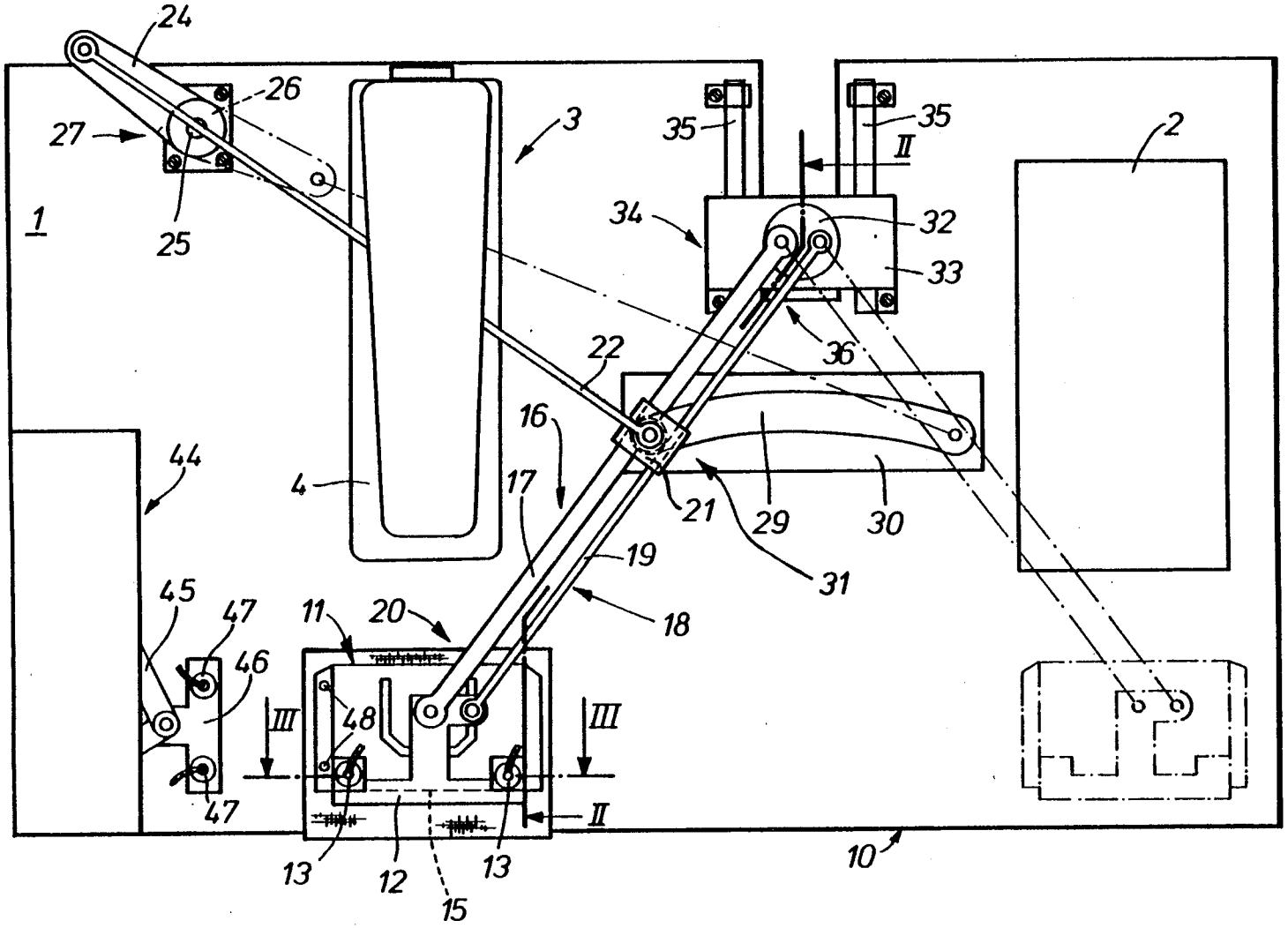
FIG. 1 is a top view of a sewing unit.

The schematically represented folder 2 and a sewing machine 3 are arranged on the table top 1 of a sewing unit. The sewing machine 3 comprises a base plate 4, a stand 5 (FIG. 2), an arm 6 and a head 7. A needle rod 8, actuated in a known manner and carrying a needle 9, is mounted in the head 7.

A work piece holder 11 with a plate receiving the work piece friction-tightly is arranged on the table top 1 directly behind the front 10 of the sewing unit serving for feeding. The work piece holder 11 is mounted on a carrier 12. Said carrier has cylinders 13 with piston rods 14, whose ends have a conical shape and can engage with bores (FIG. 3) of a respective shape provided in the work piece holder 11. The edge of the work piece holder 11 facing the front edge 10 of the sewing unit has the reference number 15.

A tie rod 16 in the shape of a swivel arm 17 and a guide rod 18 in the shape of an auxiliary rod 19 running parallel with regard to the swivel arm 17 engage with the carrier. The swivel arm 17 and the auxiliary rod 19 together with the carrier 12 working as a coupler form a transport device or means 20.

The swivel arm 17 and the auxiliary rod 19 carry a bearing block 21, on whose upside an oscillating crank 22 is engaged articulatedly and on whose bottom end a roller 23 (FIG. 2) is mounted.

The oscillating crank 22 is connected to one end of a crank 24, whose other end is mounted rotatably rigid on the rotating shaft 25 of a motor 26. The elements 22 and 24 to 26 form a driving device or means 27.

The roller 23 mounted to the bearing block 21 serves as a guide element 28 and engages with the guide slot 29 of a template mounted on the table top 1 and serving as a guide 30. The elements 23 and 30 serve as a guide device or means 31.

The swivel arm 17 and the auxiliary rod 19 are mounted swivelably around the journal of a bearing element 32. The bearing element 32 is received in a bearing device or means 34 having the shape of a slide or carriage 33. Said bearing means 34 is mounted slidably on rails 35 mounted on the table top 1 and represents the movable part of a differential arrangement 36.

Figures 2, 3, 4:
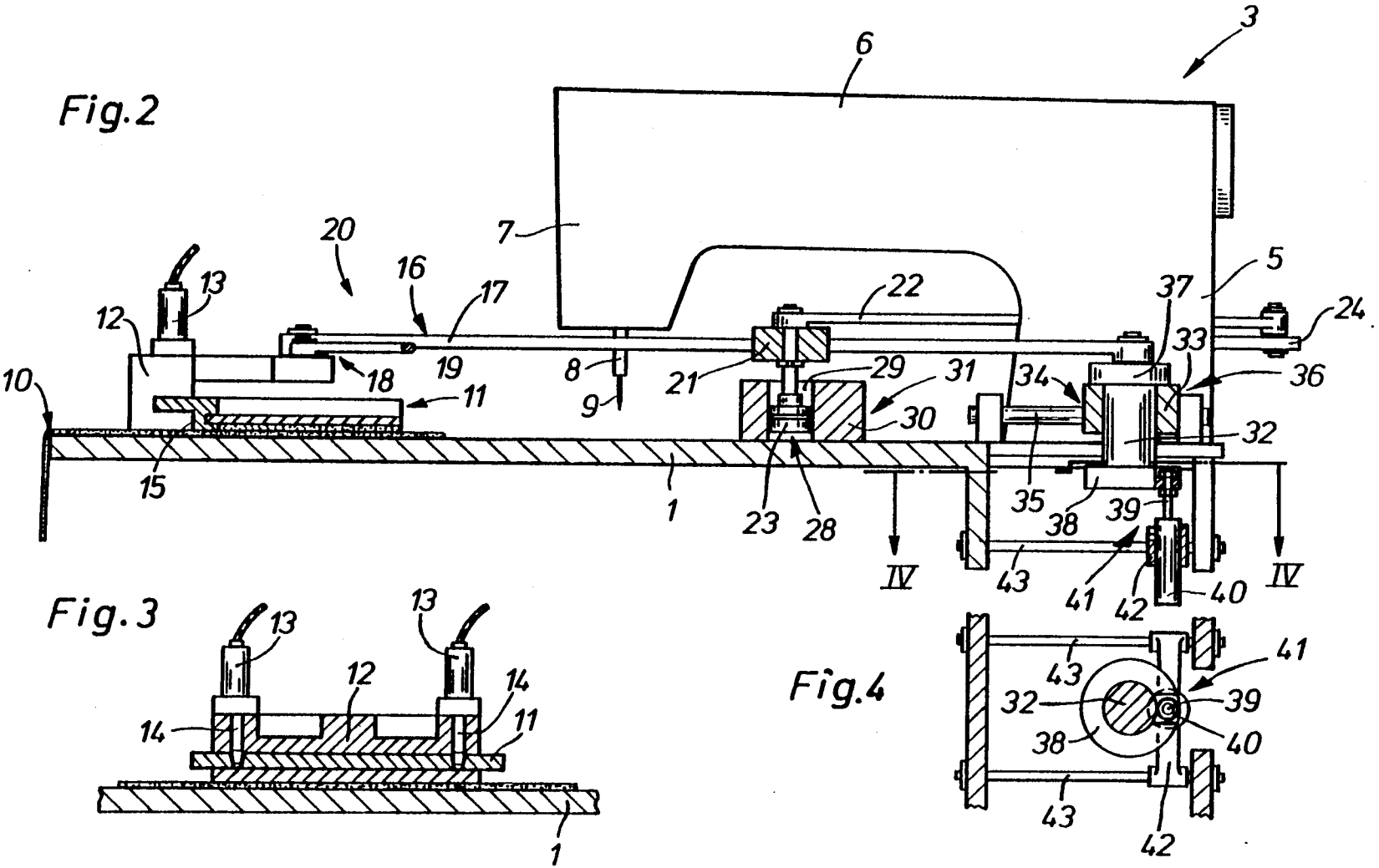
FIG. 2 is a lateral sectional view of the sewing unit taken along the line II—II of FIG. 1.
FIG. 3 is a sectional view taken alone to the line III—III of FIG. 1.
FIG. 4 is a sectional view according to the line IV—IV of FIG. 2.

As represented in FIG. 2, the bearing element 32 is guided vertically movable in a respective recess of the slide 33, the top and the bottom part of the bearing element 32 having a larger diameter than its middle part and serving as catches 37, 38. The piston rod 39 of a cylinder 40 serving as a lifting device or means 41 engages with the bottom catch 38. The cylinder 40 is carried by a slide 42, which is slidably guided on sliding rods 43 mounted parallel with regard to the rails 35 onto the table top 1.

A feed device 44 with a carrier 46 articulatedly mounted on a tie rod mechanism 45 is provided on the left side of the sewing unit in Fig. 1. The carrier 46 is provided with cylinders 47 whose piston rods are formed just like those of the cylinders 13 of the carrier 12 and which engage with the respectively shaped bores 48 of the work piece holder 11.

The arrangement works as follows:

On the right side in FIG. 1 a first layer of cloth, e.g. a shirt part or a trousers part, is positioned on the table top 1 from the front of the sewing unit. Then a second layer of cloth, e.g. a cut pocket is deposited on a pocket plate of the folder, which is not shown, and is aligned with regard to the pattern of the first layer of cloth and consequently folded.

The work piece holder 11 is lowered, from its position shown in phantom in FIG. 1, onto the now prepared work piece. A holding device (not shown) of the folder 2, which has held the work piece so far, is withdrawn.

The motor 26 is activated and pulls the transport device 20 via the crank 24 and the oscillating crank 22 into its left end position shown in full lines in Fig. 1. During this motion the roller 23 (FIG. 2) is guided in the guide slot 29 of the guide 30. The curve of the guide slot 29 is formed so that the slide 33 is pushed back by the transport device 20, and during the movement of the transport device 20 in the area from the right end of the guide slot 29 to its middle. Once the transport device has passed the 10 middle, the slide 33 is pulled forward until it reaches the left end. Herein the curve of the guide slot 29 is chosen so that the movement of the work piece holder 11, which would otherwise run around the bearing element 32 in the arc of a circle, is transformed to a straight line of the work piece holder 11 along the front edge 10 of the table top 1.

The motor 26 is deactivated in the left end position and the carrier 46 of the feed device 44 is moved from its resting position shown in FIG. 1 to the right until it covers the left edge of the work piece holder 11, with the bores 48. Now the cylinders 47 of the feed device 44, for the extension of the piston rod and the cylinders 13 of the feed device and for the contraction of the piston rods, are controlled and thus the work piece holder 11 is passed on to the feed device 44. The drive (not shown) of the feed device 44 is then controlled so that the work piece holder 11 is guided to the sewing machine 3 and moved through the stitch formation area of the sewing machine 3 following the seam construction diagram.

Subsequent to the seam formation, the feed device 44 is moved back to the left side of the carrier 12 of the transport device 20, where the work piece holder 11 is transferred back to the transport device 20 by means of a respective control of the cylinders 13 and 47. Then the feed device 44 moves back into its resting position.

The transport device 20 is lifted for the release of the work piece, so that it can be removed from the table top 1 by means of a device which is not represented.

For the lifting of the transport device 20 the cylinder 40 is controlled, so that it pushes the bearing element 32 up until the catch 38 lies close to the bottom of the slide 33.

The drive motor 26 is activated and the transport device 20 is swivelled in its lifted position from its left to its right end 15 position. Here the motor 26 is deactivated and the cylinder 40 is reset, so that it pulls the catch of the bearing element 32 against the upside of the slide 33 and therefore lowers the work piece holder 11 onto a new, prepared work piece.

During the movement of the transport device between its two end positions the slide 42 is driven by the slide 33 via the cylinder 40, so that the cylinder 40 is always moved in synchronization with the bearing element 32.

While specific embodiments of the invention have been shown and described in detail to illustrate the application of the principles of the invention, it will be understood that the invention may be embodied otherwise without departing from such principles.

What is claimed is:

1. A sewing unit, comprising: a table top work surface; a workpiece holder positioned on the table top work surface a sewing machine and transport device positioned on said table top work surface; the transport device including a tie rod with an end connected to a bearing device and another end connected to the workpiece holder, the bearing device supporting the tie rod and being connected to the tie rod behind a front edge of the workpiece holder and being movable substantially at a right angle to the path of the workpiece holder, the front edge of the workpiece holder facing a front side of the sewing unit; guide means connected to the transport device for guiding the transport device to move the workpiece holder along a path not crossing the front side of the sewing unit; and a drive device connected to the transport device for moving the transport device along the path defined by the guide means, each of the guide means, drive device and bearing device are connected to the transport device behind the front edge of the workpiece holder to provide a free access area at the front side of the sewing unit.

2. A sewing unit according to claim 1, further comprising a guide rod acting as an auxiliary rod positioned running parallel to said tie rod, said tie rod and guide rod having a first end articulated to the workpiece and having a second end articulated to the bearing device.

3. A sewing unit according to claim 1 wherein the bearing device includes a slide carriage mounted on rails.

4. A sewing unit according to claim 1, wherein the guide device includes a guide member defining a guide track, said guide track adapted for receiving a guide element connected to said transport device, said bearing device being movable in a horizontal plane in dependence upon the movement of the transport device in the guide track.

5. A sewing unit according to claim 1, wherein said guide device includes a guide member in the form of a template, said template being mounted on a table top and defining a guide slot, said transport device being connected to a guide element having a rotatably mounted roller, said rotatably mounted roller being positionable within said guide slot for movement within said guide slot.

6. A sewing unit according to claim 1, wherein said bearing device is mounted movably in a vertical direction with respect to said table top, and lifting means are connected to said bearing device for moving said bearing device in said vertical direction in dependence upon the position of the transport device.

7. A sewing unit according to claim 6, wherein said lifting means is carried by a carriage positioned on a slide movable within a horizontal plane, said bearing device and said lifting means being movable in unison.

8. A sewing unit, comprising:

a table top work surface;

a workpiece holder having a forward edge;

transport means supported on said table top work surface, said transport means being connected to said workpiece holder, said transport means for supporting said workpiece holder and moving said workpiece holder between a first and second position;

bearing means connected to said table top work surface and connected to said transport means for supporting said transport means;

driving means connected to said transport means for moving said transport means between said first and second positions; and guide means connected to said transport means for defining a path of said transport means between said first and second, positions each of said bearing means, driving means and guide means being positioned behind said forward edge of said workpiece holder and being positioned to define a free access area at a front side of the sewing machine, said bearing means includes a bearing element connected to said transport means, said bearing element being supported by slide rails allowing movement of said bearing element in a horizontal plane along said slide rails, said bearing element being movable a predetermined amount in a vertical direction, lifting means connected to said bearing element lifting said bearing element in the vertical direction.

9. A sewing unit according to claim 8, wherein said transport means includes a tie rod and guide rod arrangement, said guide rod being positioned running substantially parallel to said tie rod, each of said tie rod and guide rod having a first end connected to said workpiece holder and having a second end connected to said bearing means.

10. A sewing unit according to claim 8, wherein said driving means includes a crank member connected to a motor, said crank member being connected to an oscillating crank bar, said oscillating crank bar being connected to said transport means, actuation of said motor causing said crank member and said oscillating crank bar to move said transport means along said path of said guide means.

11. A sewing unit, comprising a table top work surface;

a workpiece holder having a forward edge;

transport means supported on said table top work surface, said transport means being connected to said workpiece holder, said transport means for supporting said workpiece holder and moving said workpiece holder between a first and second position, bearing means connected to said table top and connected to said transport means for supporting said transport means;

driving means connected to said transport means for moving said transport means between said first and second positions; and guide means connected to said transport means for defining a path of said transport means between said first and second positions, each of said bearing means, driving means and guide means being positioned behind said forward edge of said workpiece holder and being positioned to define a free access area at a front side of the sewing machine, said guide means includes a guide member defining a guide track and a guide track follower element connected to said transport means, said guide track follower element including a roller for rolling within said guide track.

* * * * *